US009922626B2

(12) United States Patent
Zager

(10) Patent No.: US 9,922,626 B2
(45) Date of Patent: Mar. 20, 2018

(54) GUITAR PICK

(71) Applicant: Zager Guitars, Lincoln, NE (US)

(72) Inventor: Dennis Zager, Lincoln, NE (US)

(73) Assignee: Zager Guitars, Lincoln, NE (US)

( * ) Notice: Subject to any disclaimer, the term of this patent is extended or adjusted under 35 U.S.C. 154(b) by 0 days.

(21) Appl. No.: 15/256,915

(22) Filed: Sep. 6, 2016

(65) Prior Publication Data

US 2017/0069301 A1 Mar. 9, 2017

Related U.S. Application Data

(60) Provisional application No. 62/215,416, filed on Sep. 8, 2015.

(51) Int. Cl.
*G10D 3/16* (2006.01)

(52) U.S. Cl.
CPC ..... *G10D 3/163* (2013.01)

(58) Field of Classification Search
USPC ..... 84/322
See application file for complete search history.

(56) References Cited

U.S. PATENT DOCUMENTS

| | | | | |
|---|---|---|---|---|
| 3,789,720 | A * | 2/1974 | McIntyre | G10D 3/163 84/322 |
| 4,228,719 | A * | 10/1980 | Keene | G10D 3/163 84/322 |
| 6,346,662 | B1 * | 2/2002 | Sielaff | G10D 3/163 84/320 |
| 7,459,620 | B1 * | 12/2008 | Kester | G10D 3/163 84/320 |
| 7,956,264 | B2 * | 6/2011 | Risolia | G10D 3/163 84/320 |
| 2010/0180748 | A1 * | 7/2010 | Fredrick | G10D 3/163 84/322 |

* cited by examiner

*Primary Examiner* — Christopher Uhlir
(74) *Attorney, Agent, or Firm* — Spruce Law Group, LLC

(57) ABSTRACT

A guitar pick is of a larger size than traditional picks and shaped as a roughly equilateral triangle. The pick has holes therethrough, with 3 of the holes equidistant from each vertex of the pick. A fourth hole may extend through the pick's center.

13 Claims, 2 Drawing Sheets

GUITAR PICK

BACKGROUND

When playing a guitar, the guitarist will often use a pick (or plectrum) to pick or strum the strings. This results in a sharp clear sound that many people prefer over other methods of playing the guitar.

Guitar picks suffer from a few common problems, however. First, they are usually small, measuring less than an inch wide and perhaps little over an inch long. Thus, the player fatigues while grasping the pick hard in his hands.

Second, guitar picks are shaped as an isosceles triangle with the smallest angled vertex acting as the end to pick the strings. This puts more stress on the end of the pick, causing it to wear out sooner.

Third, picks are solid plastic, which makes them slippery to hold especially when a player's hands grow wet with sweat.

Fourth, picks cannot be conveniently stored on a guitar. Mostly, picks are put in a pocket (thus not with a guitar) or slipped between the guitar strings, which stresses the strings, pick, and can scratch the guitar neck.

The pick described herein addresses these problems.

SUMMARY OF THE EMBODIMENTS

A guitar pick is of a larger size than traditional picks and shaped as a roughly equilateral triangle. The pick has holes therethrough, with 3 of the holes equidistant from each vertex of the pick. A fourth hole may extend through the pick's center.

DETAILED DESCRIPTION OF THE EMBODIMENTS

Figure 1:
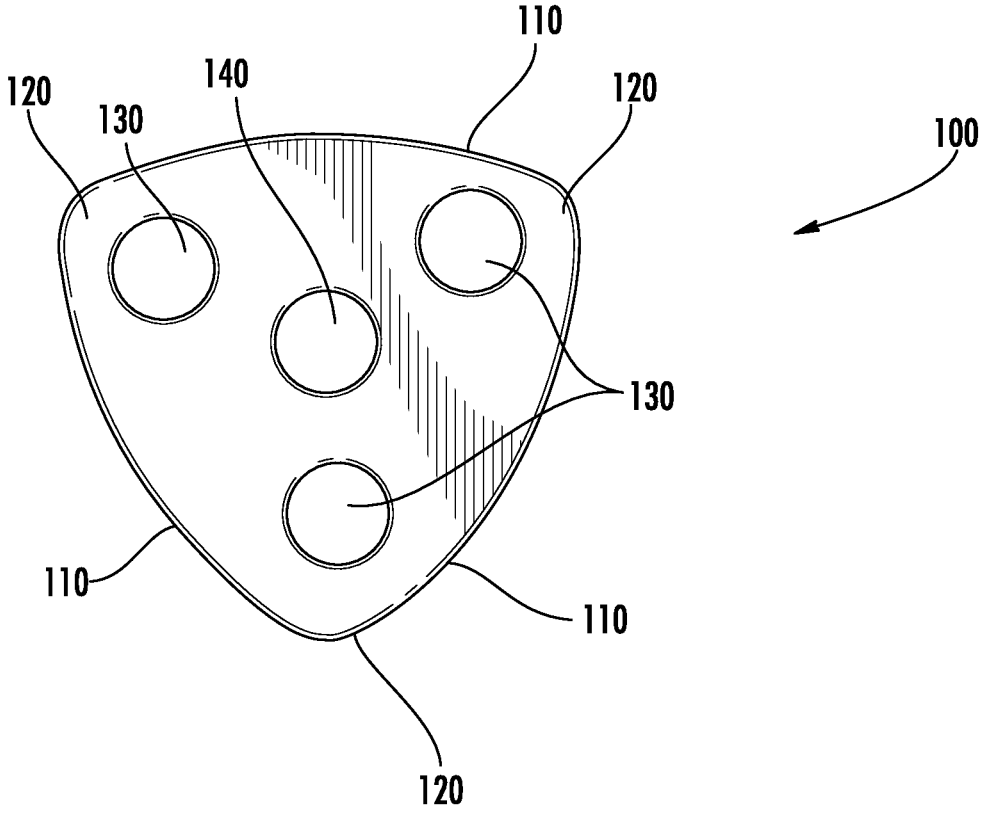
FIG. 1 shows the guitar pick.
Figure 2:
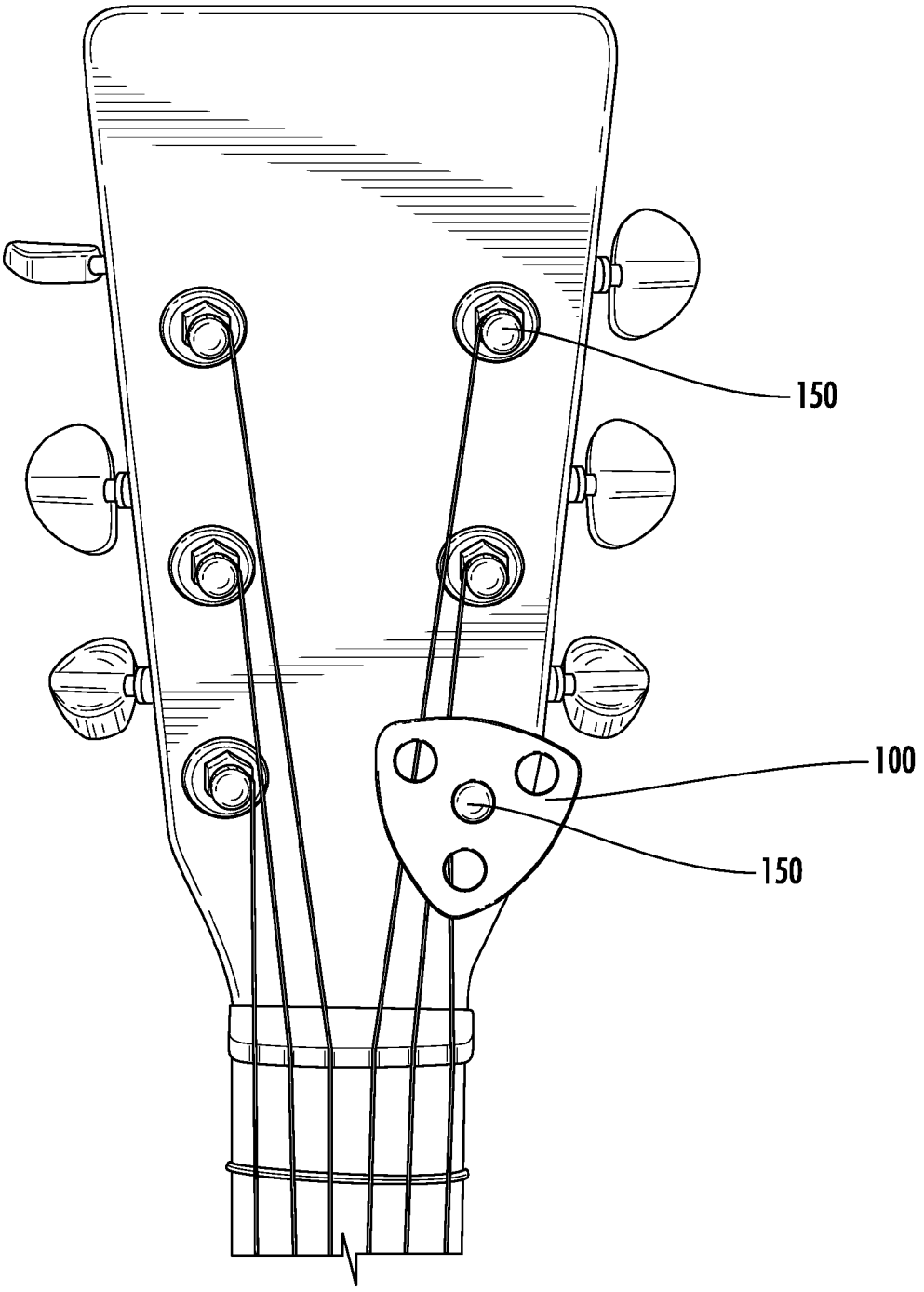
FIG. 2 shows the guitar pick mounted on a guitar tuner.

As can be seen in FIGS. 1 and 2, the guitar pick 100 is a large size guitar pick (30% larger than normal teardrop shapes) with each equilateral side 110. The sides may have a slight curve to them to aid in strengthening the pick. This sizing is significantly larger than traditional picks and has been observed to create less fatigue in a guitar player. Further, because each side 110 of the pick 100 is the same length, the player need not worry about which side faces the strings, making it easier for the player to recover a dropped or shifted pick 100. The equilateral shape also allows the pick 100 to wear evenly at each vertex 120, since any of the pick 100's vertices 120 may be used during play. The pick 100's larger size allows for a player to increase volume and power during play.

The pick 100 also has holes therein. As shown, there are 3 grip holes 130 positioned equidistant from each of the vertices 120, and a center hole 140 through the pick 100's middle. The grip holes 130 allow a user to hold the pick 100 between his thumb and fingers more securely and with less effort. There is less sweat to transfer to the pick 100, the grip holes 130 provide a cooling/wicking point on the pick 100, and the players fingers may touch through the hole 130 giving the player unique tactile feedback during play, as well as better accuracy. The center hole 140 further reduces weight, can also help in holding the pick 100, is able to function as a pivot when a user switches pick points for play, and can be used for storage. The center hole 140 may be of a different size than the grip holes 130, or not used at all. The holes 130, 140 may be circular to reduce stress points.

As can be seen in FIG. 2, the pick 100's holes 130, 140 can be sized such that they snapfit onto a guitar tuner 150. This allows for easy storage and retrieval.

The grip holes 130 also allow the vertex 120 of the pick 100 to flex more, which means that the pick 100 can be used with less force during play. Using less force means that there will be less biting/digging on strings. Less force and biting/digging means less need for retuning and longer string life, which is especially relevant as more players use coated strings.

These "flex tips" also absorb vibration transmitted to the fingers when the pick hits each string. This allows the player to hold the pick with less force which allows the player to play for longer periods with less fatigue.

These holes also make it much easier to use a classic "3 finger grip" which is extremely hard to use on a conventional teardrop shaped pick where the sides are not equal and there are no holes that a player's fingers can sink into.

While the invention has been described with reference to the embodiments above, a person of ordinary skill in the art would understand that various changes or modifications may be made thereto without departing from the scope of the claims.

The invention claimed is:

1. A guitar pick with holes extending therethrough, wherein the pick is triangular with three vertices, and three holes therethrough, wherein each hole is a grip hole and is placed such that there is one grip hole in the center of each of the three vertices, and wherein the pick is symmetrical from each of the three vertices to each opposing base, and wherein the pick has an additional center hole therethrough, wherein the pick completely surrounds the center hole and the center hole is shaped as a full circle and is sized to snap fit over a guitar tuner.

2. The guitar pick of claim 1, wherein the pick is shaped as an equilateral triangle.

3. The guitar pick of claim 1, wherein the guitar pick shape is an equilateral triangle.

4. The guitar pick of claim 3, wherein the sides of the equilateral triangle are curved.

5. The guitar pick of claim 4, wherein the center hole is equidistant from each of the three vertices.

6. The guitar pick of claim 5, wherein each vertex comprises a curved vertex.

7. The guitar pick of claim 1, wherein the pick lacks a directional orientation.

8. The guitar pick of claim 1, wherein the grip holes are each sized to snap fit over a guitar tuner.

9. A guitar pick with at least one hole extending therethrough, wherein the pick is triangular with three vertices, and wherein the pick has a center hole therethrough, wherein the pick completely surrounds the center hole and the center hole is shaped as a full circle and is sized to snap fit over a guitar tuner.

10. The guitar pick of claim 9 wherein the pick is symmetrical from each of its three vertices to each opposing base.

11. The guitar pick of claim 9 wherein the pick lacks a directional orientation.

12. A guitar pick with holes extending therethrough, wherein the pick is triangular with three vertices, and three holes therethrough, wherein each hole is a grip hole, and wherein the pick has an additional center hole therethrough, wherein the pick completely surrounds the center hole and the center hole is shaped as a full circle and is sized to snap fit over a guitar tuner.

13. The guitar pick of claim 12 wherein the three holes are each sized to fit over a tuner.

* * * * *